US007611337B2

(12) United States Patent
Reverberi et al.

(10) Patent No.: US 7,611,337 B2
(45) Date of Patent: Nov. 3, 2009

(54) HYDRAULIC PUMP

(75) Inventors: Stefano Reverberi, Modena (IT); Alberto Rocchi, Castelfranco Emilia (IT); Fabrizio Fabbri, Modena (IT)

(73) Assignee: Annovi Reverberi S.p.A., Modena (IT)

( * ) Notice: Subject to any disclaimer, the term of this patent is extended or adjusted under 35 U.S.C. 154(b) by 612 days.

(21) Appl. No.: 10/867,638

(22) Filed: Jun. 16, 2004

(65) Prior Publication Data

US 2005/0135953 A1 Jun. 23, 2005

(30) Foreign Application Priority Data

Dec. 19, 2003 (IT) ..... RE2003U0032

(51) Int. Cl.
*F04B 1/12* (2006.01)

(52) U.S. Cl. ..... 417/269; 417/360; 417/521; 417/529

(58) Field of Classification Search ..... 417/269, 417/521, 529, 360; 92/71
See application file for complete search history.

(56) References Cited

U.S. PATENT DOCUMENTS

| | | | |
|---|---|---|---|
| 1,467,233 | A | 9/1923 | Crumb |
| 1,777,852 | A | 10/1930 | Lawrence |
| 2,142,834 | A | 1/1939 | Bergstrom |
| 2,250,306 | A | 7/1941 | LaBour |
| 2,849,958 | A | 9/1958 | Mitchell |
| 2,977,891 | A | 4/1961 | Bishop |
| 3,070,031 | A | 12/1962 | Puryear |
| 3,415,160 | A | 12/1968 | Stein et al. |
| 3,458,114 | A | 7/1969 | Catterson |
| 3,586,238 | A | 6/1971 | Schmierer |
| 3,791,766 | A | 2/1974 | Kikutsugi et al. |
| 3,847,504 | A | 11/1974 | Martin |
| 3,949,567 | A | 4/1976 | Stech |
| 3,961,562 | A | 6/1976 | Kersten et al. |
| 4,005,948 | A | 2/1977 | Hiraga et al. |
| 4,019,704 | A | 4/1977 | Levine |
| 4,028,010 | A | 6/1977 | Hopkins |
| 4,033,641 | A | 7/1977 | Cain et al. |
| 4,195,970 | A | 4/1980 | Zalis |
| 4,211,519 | A | 7/1980 | Hogah |
| 4,226,574 | A | 10/1980 | Villette |

(Continued)

FOREIGN PATENT DOCUMENTS

| | | | |
|---|---|---|---|
| CA | 2100762 | A1 | 5/1993 |

(Continued)

OTHER PUBLICATIONS

Operating Instructions, Kaercher Brochure dated Feb. 1993.

*Primary Examiner*—Devon C Kramer
*Assistant Examiner*—Philip Stimpert
(74) *Attorney, Agent, or Firm*—Browdy and Neimark, P.L.L.

(57) ABSTRACT

Pump, comprising a casing that is generally cup-shaped intended to be fixed to a driving motor (3), and containing a drive shaft (6) suitable for being coupled with said motor, and having a tilted surface for the actuation of one or more pistons (7) that move parallel to the axis of said drive shaft, where said casing consists of a monolithic body (2) that comprises means (4) for its attachment to said motor, a system for supporting and holding said drive shaft, and the guide and sliding seats of the quoted pistons.

7 Claims, 3 Drawing Sheets

U.S. PATENT DOCUMENTS

| | | | | | |
|---|---|---|---|---|---|
| 4,230,438 | A | | 10/1980 | Lehmann et al. | |
| 4,268,096 | A | | 5/1981 | Cain et al. | |
| 4,272,224 | A | | 6/1981 | Kabele | |
| 4,307,857 | A | | 12/1981 | Godbersen | |
| 4,392,794 | A | | 7/1983 | Foxcroft | |
| 4,512,728 | A | * | 4/1985 | Nakano et al. | 418/3 |
| 4,538,967 | A | | 9/1985 | Furukawa | |
| 4,568,252 | A | * | 2/1986 | Hattori et al. | 417/269 |
| 4,611,529 | A | | 9/1986 | Stricker et al. | |
| 4,631,433 | A | | 12/1986 | Stokes | |
| 4,632,642 | A | | 12/1986 | Meister, III et al. | |
| 4,634,908 | A | | 1/1987 | Sturm | |
| 4,677,335 | A | | 6/1987 | Ueda et al. | |
| 4,684,330 | A | | 8/1987 | Andersson et al. | |
| 4,793,774 | A | | 12/1988 | Bradt et al. | |
| 4,822,241 | A | | 4/1989 | Jarvis et al. | |
| 4,999,020 | A | | 3/1991 | Stocco et al. | |
| 5,040,943 | A | | 8/1991 | Dwyer et al. | |
| 5,174,318 | A | | 12/1992 | Dingler et al. | |
| 5,215,443 | A | | 6/1993 | Hani et al. | |
| 5,249,402 | A | | 10/1993 | Crick et al. | |
| 5,306,121 | A | | 4/1994 | Heflin et al. | |
| 5,494,414 | A | | 2/1996 | Steinhart et al. | |
| 5,530,304 | A | | 6/1996 | Mirumachi et al. | |
| 5,567,130 | A | | 10/1996 | Kvinge et al. | |
| 5,615,999 | A | | 4/1997 | Sukup | |
| 5,653,584 | A | | 8/1997 | Mazzucato et al. | |
| 5,716,200 | A | | 2/1998 | Mirumachi et al. | |
| 5,747,903 | A | | 5/1998 | Klingler | |
| 5,793,134 | A | * | 8/1998 | Worm | 310/82 |
| 5,794,515 | A | | 8/1998 | Bethke | |
| 5,803,714 | A | | 9/1998 | Tominaga et al. | |
| 5,823,752 | A | | 10/1998 | Hoenisch et al. | |
| 5,975,863 | A | | 11/1999 | Mazzucato | |
| 5,980,220 | A | | 11/1999 | Mazzucato et al. | |
| 6,112,641 | A | | 9/2000 | Magri et al. | |
| D528,982 | S | | 9/2006 | Reverberi | |
| D532,793 | S | | 11/2006 | Reverberi | |
| D536,005 | S | | 1/2007 | Reverberi | |
| 2002/0006340 | A1 | | 1/2002 | Nathan | |
| 2003/0175134 | A1 | | 9/2003 | Matsubara et al. | |
| 2005/0135953 | A1 | | 6/2005 | Reverberi et al. | |
| 2006/0024173 | A1 | | 2/2006 | Rocchi et al. | |

FOREIGN PATENT DOCUMENTS

| | | | |
|---|---|---|---|
| DE | 21 46 815 | A1 | 8/1972 |
| DE | 32 08 552 | C1 | 4/1983 |
| DE | 85 14 497 | U1 | 7/1985 |
| DE | 4143413 | | 8/1993 |
| DE | 43 38 896 | | 6/1994 |
| DE | 198 35 335 | C1 | 8/1997 |
| DE | 89 16 241 | U1 | 12/1998 |
| EP | 0 503 298 | A1 | 9/1992 |
| FR | 979 507 | A | 4/1951 |
| GB | 646 371 | A | 11/1950 |
| GB | 750 735 | | 6/1956 |
| GB | 957 296 | | 5/1964 |
| GB | 1 333 540 | | 10/1973 |

* cited by examiner 1
2
3
4
6
7
7
8
9
10
11
11
12
16
17
17
18
18
19
20
21
21
22
60
61
62
63
64
65
66
67
77
88
111
112
II

HYDRAULIC PUMP

BACKGROUND OF THE INVENTION

1. Technical Field of the Invention

The present finding refers, in a totally general way, to hydraulic pumps with axial pistons a typical use of which is on washing apparatuses.

More specifically, it concerns improvements brought to the casings that house the kinematic actuation apparatus of these pumps.

2. Prior Art

Pumps with axial pistons, also manufactured by the Applicant, are known that comprise a motorised drive shaft that is rotatably mounted in a casing where it carries a tilted end plate against which a circumferential series of pistons, usually of the plunger type, is elastically rested, directly or with the interposition of an idle thrusting ring.

Said plunger pistons are arranged around the axis of said drive shaft, and parallel to it.

The casing of such known pumps is of the modular type and comprises a cup-shaped body and a flanged annular body that is intended to be fixed, on one side onto the mouth of said cup-shaped body, and on the other side against the structure of the driving motor of the shaft that drives the pistons.

In particular, said annular body is dedicated to the support of said drive shaft, and said cup-shaped body is arranged for guiding said pistons, which surpass its bottom to insert into respective operating chambers of a suction and delivery collector that is fixed to the outside of said bottom.

The use of these pumps has shown that said modular casing is disadvantageous at least for the following reasons: a relatively large number of component parts, therefore also corresponding constructive complexity that has negative repercussions both on the reliability and on the assembly methods and times.

With particular reference to these assembly times and methods, according to the prior art identified above to assemble the casing it is necessary to operate substantially as follows.

The pistons and the relative accessories are associated airtight with the cup-shaped body; the drive shaft and the respective accessories are mounted airtight on the annular body; cup-shaped body and annular body are joined together through said flanged annular body.

The above requires substantial operating time, with obvious consequences on the costs.

OBJECT AND SUMMARY OF THE INVENTION

The main purpose of the present finding is that of eliminating, or at least to highly decrease, the problem identified above in the context of a constructive solution that is simple, rational, reliable and cost-effective, and having a small number of component parts, therefore easy and quick to assemble.

Said purposes are accomplished thanks to an improved pump having the characteristics outlined in the main claim.

Advantageous and preferred embodiments of means provided for this are outlined in the dependent claims.

BRIEF DESCRIPTION OF THE DRAWINGS

The characteristics and constructive merits of the finding shall become clear from the following detailed description, made with reference to the figures of the attached tables of drawings, where.

DETAILED DESCRIPTION OF THE PREFERRED EMBODIMENT(S) OF THE INVENTION

Figure 1:
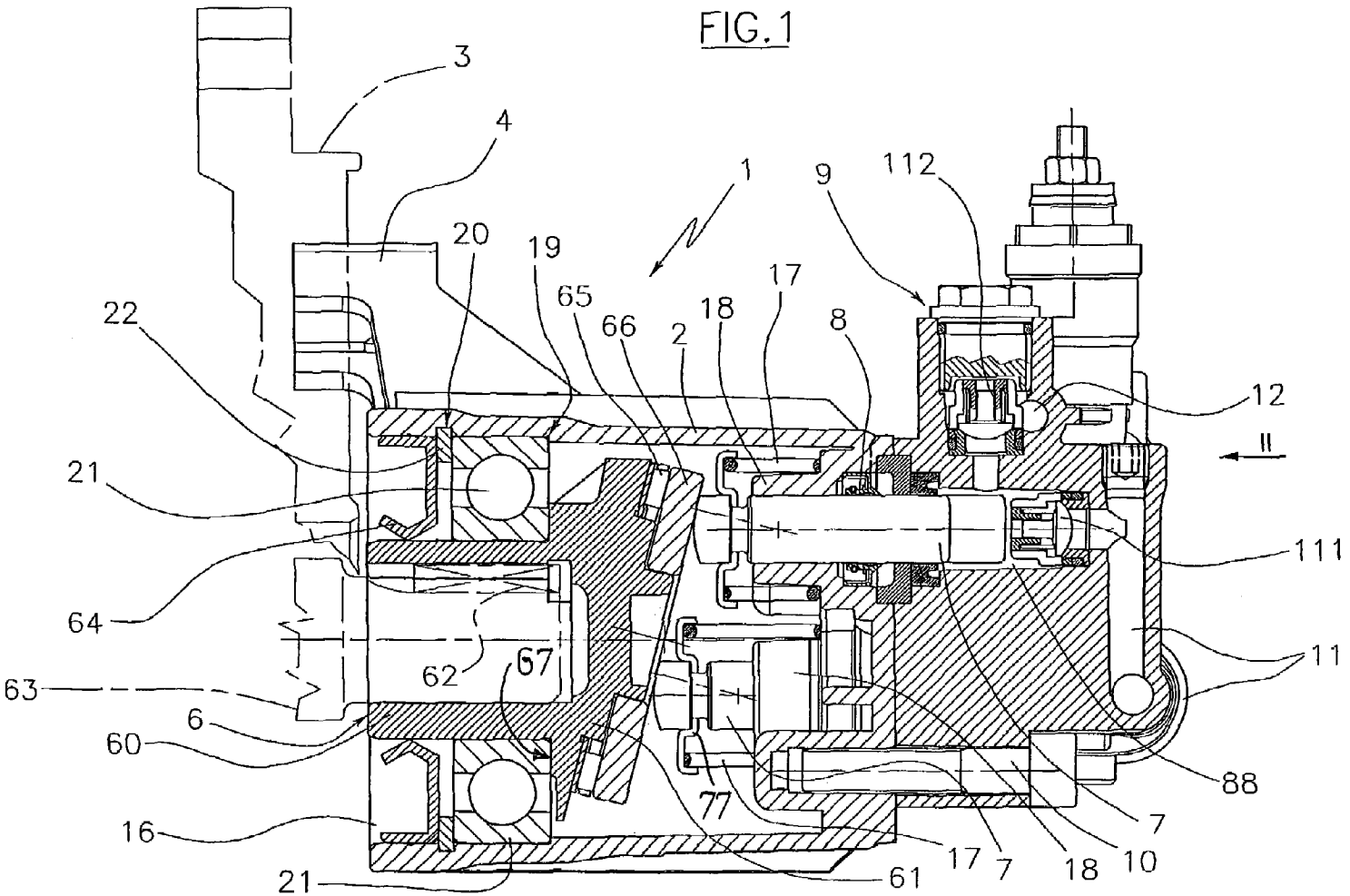
FIG. 1 is the section I-I shown in FIG. 2.

From the quoted figures it should be noted that there is a crankcase 2 that contains all of the kinematic actuation system of the pump (see FIG. 1), this pump being wholly indicated with 1 in all of the figures.

Said crankcase 2 consists of a cup-shaped monolithic body, outside the mouth of which the attachment means to the structure of an electric motor 3 (FIG. 1) for driving the pump 1 are foreseen.

Said attachment means (FIGS. 1-3) consists of three shaped radial appendixes 4 which at the free end have a hole 5 for the passage of suitable firm attachment elements, like threaded members.

Figure 2:
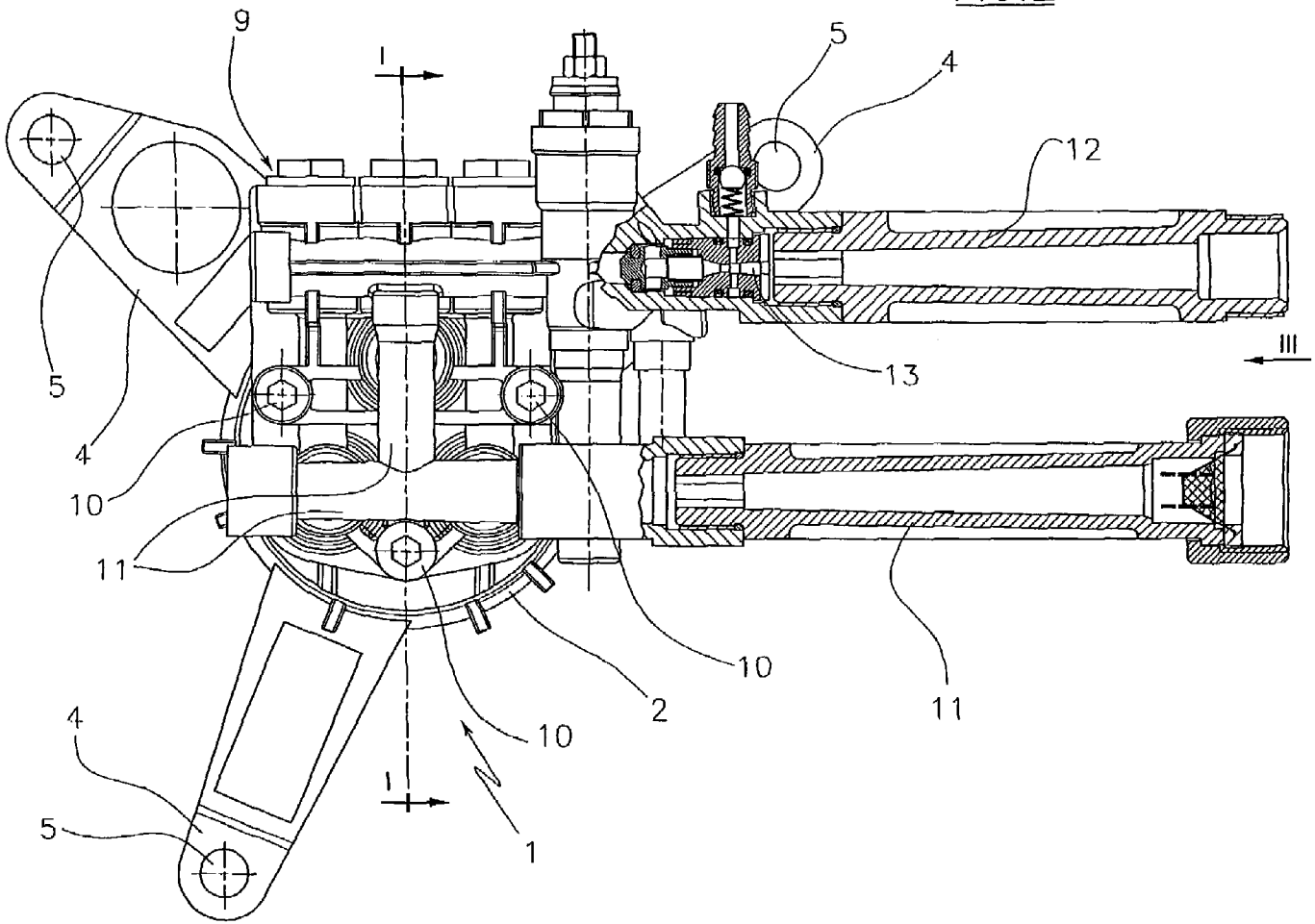
FIG. 2 is the view obtained according to the direction II shown in FIG. 1.

Said cup-shaped crankcase 2 houses, starting from the left with reference to FIG. 1, a coaxial rotating drive shaft 6 and a circumferential series of pistons 7 that are parallel to each other and equally angularly spaced apart, which are arranged around the axis of said shaft 6.

In the case that is shown three pistons 7 are foreseen.

Each individual piston 7 is slidably mounted, with interposition of suitable sealing elements 8 (FIG. 1), in a guide sleeve 18 that is formed in a single piece with the bottom of the crankcase 2, and is completely contained in it.

The seat of said sealing elements 8 is formed at the outer mouth of the sleeve 18, and on the same sleeve 18 a compressed helical spring 17 is slotted, which is intended to keep the piston 7 constantly elastically thrusted towards the shaft 6 thanks to the small plate indicated with 77 in FIG. 1.

The pistons 7 surpass said bottom to insert into respective operating chambers 88 of a suction and delivery collector 9 that is fixed to the quoted bottom through the threaded members indicated with 10.

The collector 9 is of the known type and comprises, in brief, a suction circuit 11 and a delivery circuit 12 (FIGS. 1-3) that are connected to said operating chambers 8 with interposition of the automatic valves indicated with 111 and 112 respectively (see FIG. 1).

Moreover, at the end downstream of the delivery circuit 12 a Venturi device 13 is associated (FIGS. 2 and 3) thanks to which the water intended to be used can be suitably conditioned, for example have detergent added to it.

As is well illustrated in FIG. 1, the initial part of the recess of the crankcase 2 consists of a cylindrical surface 16 that terminates with a sunken shoulder 19, and which is intercepted by an intermediate circumferential throat 20.

The surface portion 16 that is situated between said shoulder 19 and said throat 20 constitutes the seat for the outer ring of a rolling bearing 21, in the present case a ball bearing, said outer ring being kept in position by the quoted shoulder 19 and by a broken elastic ring, like a Seeger ring, that is coupled with said throat 20.

Finally, the shaft 6 comprises a rear hollow cylindrical shank 60 and an opposite circular plate 61 the axis of which is tilted with respect to that of the shank 60.

The output shaft 63 of the motor 3 is coupled with the shank 60 through the key 62; the same shank 60 is supported by the inner ring of the bearing 21, and it is sealed with respect to the cylindrical surface 16 through the gasket 64 situated against the Seeger ring 22.

Lastly, again see FIG. 1, the tilted face of the plate 61 has a double-step shape, where the lower step carries a flat annular bearing with rollers 65, and the upper step acts as a guide for a thrusting ring 66 that is supported by the latter.

The interfacing hemispherical ends of the pistons 7 rest against the thrusting ring 66, and the thrusts in play are countered by the inner side of the inner ring of the bearing 21 against which a rear collar 67 of the plate 61 rests.

Figure 3:
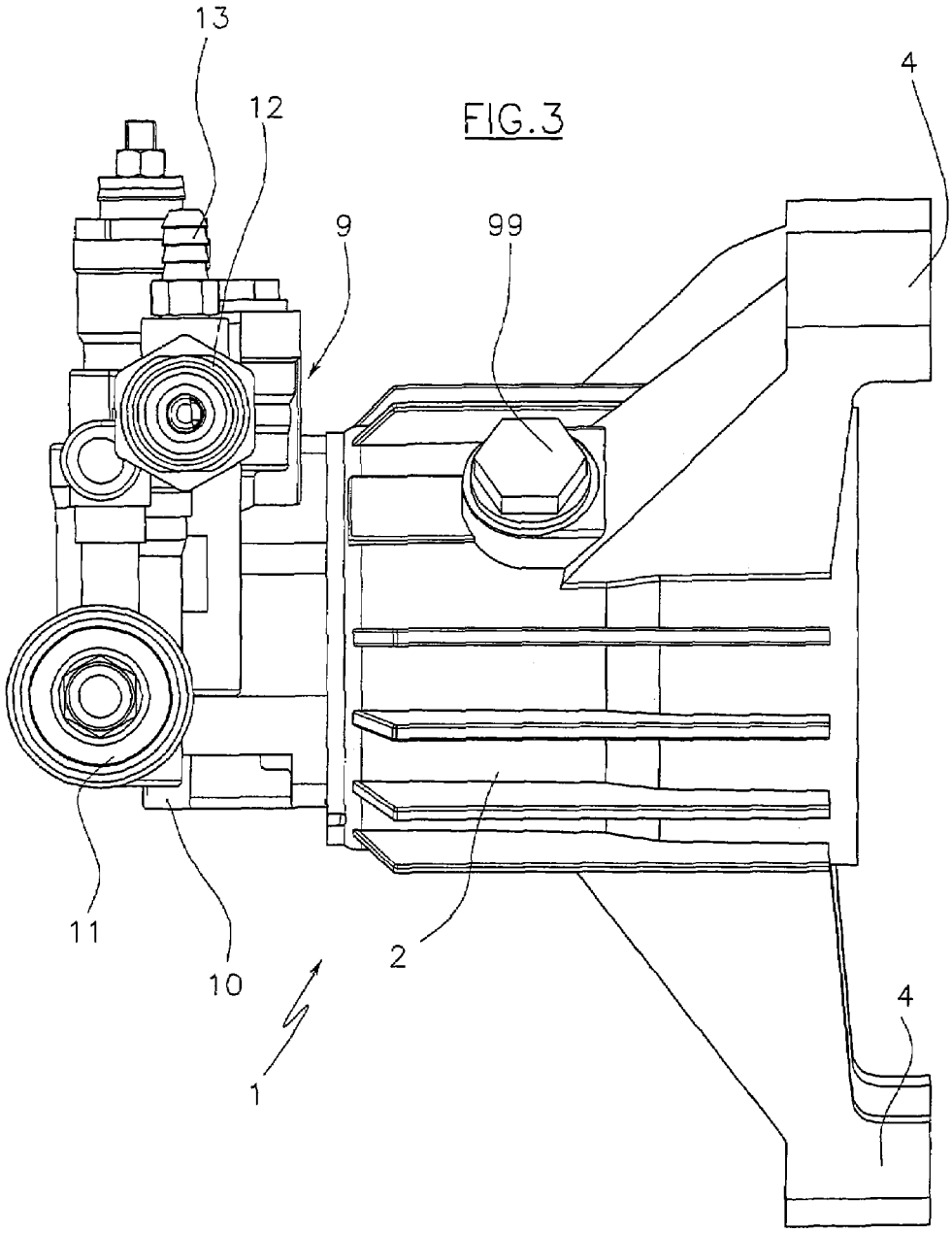
FIG. 3 is the view obtained according to the direction III shown in FIG. 2.

Of course, an oil bath is foreseen in the crankcase 2, accessible through the cap 99 illustrated in FIG. 3.

The assembly of the pump 1 is particularly quick and easy, and substantially takes place as follows.

Once the pistons 7 have been mounted in the usual manner and the collector 9 has been installed, the bearing 21, already equipped with the shaft 6 with the respective accessories, is arranged in its seat 16 and is locked here through the Seeger ring 22.

With the gasket 64 mounted and the oil introduced through the cap 99, the crankcase 2 is installed on the motor 3.

Of course, the oil can be introduced into the crankcase 2 held in upright position, before the mounting of the gasket 64.

In operation, for each turn of the shaft 6 each piston 7 completes a complete outward and inward stroke, of which the first, corresponding to the compression phase, is driven by the thrusting ring 66 that also compresses the spring 17, whereas the second suction phase is due to the extension of the same spring 17.

The invention claimed is:

1. A pump, comprising a casing that is generally cup-shaped adapted to be directly fixed to a driving motor (3), and containing a drive shaft (6) adapted to engage said motor having a tilted surface to actuate one or more pistons (7) that move parallel to the axis of said drive shaft;

wherein each of said pistons is slidably mounted with interposition of a sealing element directly in a guide sleeve formed in one piece with said casing;

wherein said casing is a monolithic body fully open at one end having radial appendices formed in one piece therewith which directly engage said monolithic body to said motor;

wherein a system which supports and holds said drive shaft includes a bearing located near said open end of the casing and retained in position between a shoulder of the casing and an elastic Seeger ring constrained in a circumferential throat in said casing; and wherein said casing has internal dimensions transverse to the axis of said drive shaft, and said drive shaft and said system which supports and holds said drive shaft have external dimensions transverse to the axis of said drive shaft, configured to enable said pistons, said drive shaft and said system which supports and holds said drive shaft to be installed in said casing via said open end of said casing.

2. The pump according to claim 1, wherein said radial appendices extend radially from the monolithic body and are equipped with engagement seats for respective devices for locking to the motor.

3. The pump according to claim 1, wherein the bearing placed between said monolithic body and drive shaft is kept between a shoulder of said body and a broken elastic ring.

4. The pump according to claim 3, wherein the outer annular part is received in a respective seat of the monolithic body, and axially locked here, and an inner annular part abuts a collar extending from said tilted surface.

5. Pump according to claim 1, wherein a mouth of said monolithic body is closed airtight by an annular gasket placed between a seat of the bearing and the drive shaft.

6. The pump according to claim 1, wherein said guide sleeve has a sleeve that is realised in a single piece with a bottom of said monolithic body, which is completely contained in the latter, wherein an outer mouth of said sleeve has a seat for at least one said sealing element for the respective piston.

7. The pump according to claim 1, wherein the bearing has ball bearings therein having axes of rotation parallel to the axis of the drive shaft.

* * * * *